US008834652B2

(12) United States Patent
Takahashi et al.

(10) Patent No.: US 8,834,652 B2
(45) Date of Patent: Sep. 16, 2014

(54) ZINC BASE ALLOY

(75) Inventors: Koukichi Takahashi, Fukushima (JP); Satoshi Katagiri, Fukushima (JP)

(73) Assignee: Nisso Metallochemical Co., Ltd., Tokyo (JP)

( * ) Notice: Subject to any disclaimer, the term of this patent is extended or adjusted under 35 U.S.C. 154(b) by 12 days.

(21) Appl. No.: 13/021,049

(22) Filed: Feb. 4, 2011

(65) Prior Publication Data

US 2011/0192502 A1 Aug. 11, 2011

(30) Foreign Application Priority Data

Feb. 8, 2010 (JP) ..... 2010-025883

(51) Int. Cl.
*C22C 18/04* (2006.01)
*C22C 18/00* (2006.01)
*C22C 18/02* (2006.01)

(52) U.S. Cl.
CPC ..... *C22C 18/02* (2013.01); *C22C 18/00* (2013.01); *C22C 18/04* (2013.01)
USPC ..... 148/441; 420/515; 420/516

(58) Field of Classification Search
USPC ..... 148/441; 420/515, 516
See application file for complete search history.

(56) References Cited

FOREIGN PATENT DOCUMENTS

| | | | | |
|---|---|---|---|---|
| CA | 1158461 | A1 | | 12/1983 |
| DE | 663274 | C | | 9/1980 |
| FR | 2450281 | A1 | | 9/1980 |
| GB | 2046302 | A | * | 11/1980 |
| JP | 58129070 | A | | 8/1983 |
| JP | 01-234539 | A | | 9/1989 |
| JP | 06-049572 | A | | 2/1994 |
| JP | 6049572 | A | | 2/1994 |
| JP | 7278707 | A | | 10/1995 |
| JP | 2009-256703 | A | | 11/2009 |
| JP | 2009293075 | A | * | 12/2009 |

OTHER PUBLICATIONS

European Search Report and Annex for EP 11 15 2990, Nov. 7, 2011.

* cited by examiner

*Primary Examiner* — Sikyin Ip
(74) *Attorney, Agent, or Firm* — Westerman, Hattori, Daniels & Adrian, LLP

(57) ABSTRACT

Provided is a zinc base alloy having high strength, and being excellent in toughness and abrasion resistance. The zinc base alloy contains 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, and, as necessary, 0.005% by weight or more and 0.1% by weight or less of Sr, and balance of Zn and inevitable impurities. Also provided is a die-cast product made from the zinc base alloy.

20 Claims, No Drawings

ZINC BASE ALLOY

TECHNICAL FIELD

The present invention relates to a zinc base alloy. More specifically, the present invention relates to a zinc base alloy having high strength, and being excellent in toughness and abrasion resistance and being suitable for die casting.

BACKGROUND ART

The zinc base alloy is an alloy that has been known from long ago as a material having a low-melting point. The zinc base alloy is mainly used in die casting. Typical examples of a die-cast product of the zinc base alloy include automobile body parts such as automobile brake pistons, seatbelt winder fixing parts, automobile radiator grill malls, and carburetors; industrial machine parts such as gears; and VTR drum cases. The zinc base alloy is also used, for example, as base materials for friction materials such as clutches and alkaline battery negative-electrode active materials and also used for, for example, corrosion control paint and plating.

As such a zinc base alloy, for example, PTL 1 proposes a high strength zinc base alloy for die casting. The zinc base alloy consisting of 12 to 30% by weight of aluminum, 6 to 20% by weight of copper, 0.01 to 0.1% by weight of magnesium, and balance of zinc and inevitable impurities. Specifically, a Zn—Al—Cu—Mg alloy is disclosed.

PTL 2 proposes a zinc base alloy containing at least one alloy element selected from the group consisting of 0.1% by weight or less of Li, 0.1% by weight or less of Be, 0.1% by weight or less of Na, 0.1% by weight or less of Mg, 25% by weight or less of Al, 0.1% by weight or less of Si, 0.1% by weight or less of K, 0.1% by weight or less of Ca, 0.1% by weight or less of Ti, 0.1% by weight or less of V, 0.1% by weight or less of Mn, 0.1% by weight or less of Fe, 0.1% by weight or less of Co, 0.1% by weight or less of Ni, 15% by weight or less of Cu, 1% by weight or less of Cd, 1% by weight or less of In, 1% by weight or less of Sn, and 1% by weight or less of Sb, wherein the s-orbit energy level Mk calculated for zinc and each alloy element by a molecular orbital approach, the mole fraction of each alloy element, and the a certain mechanical property Mp of the alloy satisfy predetermined standard curves. Specifically, a Zn—Al—Cu alloy is disclosed.

PTL 3 proposes a zinc base alloy powder, for corrosion control paint, composed of at least one addition element selected from Ni, Cu, Si, Ti, Sb, Ag, Cr, Be, Ca, Co, Na, K, In, Li, Sr, and Mg, and balance of Zn. Specifically, a Zn—Ni—Mg alloy, a Zn—Al—Ni alloy, a Zn—Mg—Cr alloy, a Zn—Mg alloy, and a Zn—Al—Mg alloy are disclosed.

CITATION LIST

Patent Literature

PTL 1: Japanese Patent Laid-Open No. H6-49572
PTL 2: Japanese Patent Laid-Open No. H7-278707
PTL 3: Japanese Patent Publication No. S63-6115

SUMMARY OF INVENTION

Technical Problem

The zinc base alloys specifically described in the above-mentioned patent literatures and the like are satisfactory in mechanical strength or corrosion control, but they may be inferior in toughness and abrasion resistance.

The present invention has been made considering such circumstances in the prior art, and it is an object of the present invention to provide a zinc base alloy having high strength and being excellent in toughness and abrasion resistance.

Solution to Problem

The present inventors have conducted intensive studies in an attempt to solve the above-mentioned problems and found that a zinc base alloy having high strength and being excellent in toughness and abrasion resistance can be obtained by adding given amounts of Al, Cu, Mg and Ca, and, as necessary, Sr to Zn and melting them. The present invention has been accomplished based on this finding.

That is, the present invention includes the followings:

(1) a zinc base alloy comprising 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, and balance of Zn and inevitable impurities;

(2) a zinc base alloy comprising 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, 0.005% by weight or more and 0.1% by weight or less of Sr, and balance of Zn and inevitable impurities;

(3) the zinc base alloy according to the above (1) or (2) for die casting; and (4) a die-cast product made from the zinc base alloy according to the above (1) or (2).

Advantageous Effects of Invention

The zinc base alloy of the present invention has high strength and is excellent in toughness and abrasion resistance. The die-cast product obtained using the zinc base alloy of the present invention has both high strength and excellent toughness and is, thereby, hardly mechanically broken even if a defect occurs. Furthermore, the die-cast product according to the present invention having excellent abrasion resistance is suitable for, for example, bearings and gears.

DESCRIPTION OF EMBODIMENTS

The zinc base alloy of the present invention comprises Al, Cu, Mg, Ca, and balance of Zn and inevitable impurities.

The zinc base alloy according to the present invention preferably further comprises Sr, in addition to the above-mentioned elements.

The content of Al in the zinc base alloy of the present invention is 3.5% by weight or more and 4.5% by weight or less, preferably 3.5% by weight or more and 4.0% by weight or less.

The above-mentioned Al content range results in forming of eutectic that is β-phase and decrease of the melting point to give a satisfactory casting performance. In addition, Al is solid-dissolved in the primary phase that is α-phase, and curing accompanied by precipitation aging improves tensile strength, hardness and abrasion resistance. In an Al content of smaller than 3.5% by weight, the above-described effects are insufficient. On the contrary, an Al content of greater than 4.5% by weight decreases toughness, which may degrade the casting performance.

The content of Cu in the zinc base alloy of the present invention is 3.0% by weight or more and 4.0% by weight or less, preferably 3.0% by weight or more and 3.8% by weight or less.

In the above-mentioned Cu content range, Cu is solid-dissolved in the primary phase that is α-phase and the eutectic that is β-phase, and curing accompanied by precipitation aging improves tensile strength and hardness. In addition, forming and dispersing of a hard ϵ-phase being Zn—Cu intermetallic compound improves the abrasion resistance. In a Cu content of smaller than 3.0% by weight, the above-described effects are insufficient. On the contrary, a Cu content of greater than 4.0% by weight makes the intermetallic compound coarse, which may decrease toughness and may degrade the casting performance.

The content of Mg in the zinc base alloy of the present invention is 0.01% by weight or more and 0.08% by weight or less, preferably 0.02% by weight or more and 0.06% by weight or less.

The above-mentioned Mg content range improves strength, hardness and abrasion resistance. In addition, intergranular corrosion is effectively inhibited. In a Mg content of smaller than 0.01% by weight, the above-described effects are insufficient. On the contrary, a Mg content of greater than 0.08% by weight may degrade toughness.

The content of Ca in the zinc base alloy of the present invention is 0.005% by weight or more and 0.1% by weight or less, preferably 0.005% by weight or more and 0.06% by weight or less.

The above-mentioned Ca content range improves strength, hardness and abrasion resistance. When Ca has a content of 0.005% by weight or more and coexists with Cu, a Zn—Cu—Ca intermetallic compound is formed, which makes the above-mentioned effects significant. However, a Ca content of greater than 0.1% by weight makes the intermetallic compound coarse, which may decrease toughness and may degrade the casting performance.

The zinc base alloy of the present invention preferably further contains Sr. The Sr content is preferably 0.005% by weight or more and 0.1% by weight or less, more preferably 0.005% by weight or more and 0.06% by weight or less.

The above-mentioned Sr content range improves toughness and abrasion resistance. When Sr has a content of 0.005% by weight or more and coexists with Ca, a fine Zn—Cu—Ca intermetallic compound is formed, which makes the above-mentioned effects significant. However, a Sr content of greater than 0.1% by weight forms a Zn—Sr intermetallic compound, which may degrade toughness.

The zinc base alloy of the present invention can be obtained by adding Al, Cu, Mg, and Ca and, as necessary, Sr to Zn in the above-mentioned contents and melting them. The method of melting is not particularly limited. For example, granules, ingots, or briquettes of metals or metal oxides containing the above-mentioned elements are mixed at predetermined amounts and are melted in a melting furnace to obtain a molten metal, and followed by solidification of the molten metal.

The zinc base alloy of the present invention is suitable for die casting. The term "die casting" refers to formation of a cast product by melting an alloy and injecting the molten alloy to a mold.

The die casting is excellent in the degree of freedom in machining and excellent in accuracy of dimension, and is also effective for producing those having large variation in thickness or those having thin shapes. In addition, in die casting, since a molten metal is injected into a die under high pressure at a high speed and is rapidly solidified by quenching, a fine and dense texture is obtained to provide high strength. Furthermore, the casting speed is high, and also a large number of products can be produced by single injection. Therefore, the die casting is also excellent in mass production compared to other methods, and automated mass production is also possible.

In some known machines for die casting, a molten metal is poured into a sleeve, followed by application of pressure with a plunger chip to inject the molten metal into a cavity. Such machines are classified into a cold chamber type and a hot chamber type, and either type can be used in the present invention.

The cold chamber type die casting machine can produce large products. In addition, casting under high pressure is possible, and a high effect by rapid quenching is obtained. Therefore, a molded product having high strength is obtained.

The hot chamber type die casting is excellent in casting speed, and melting or casting at a low temperature is possible. Therefore, a low-cost molded product can be obtained. In addition, since oxides and air-inclusion, which cause cast defects, are low, a high-quality molded product can be obtained.

Furthermore, according to performance required to a die casting product, special die casting, such as vacuum die casting, laminar flow die casting, squeeze die casting, oxygen die casting, or semi-solid die casting, can be conducted.

The die-cast product obtained from the zinc base alloy of the present invention has high strength and is excellent in toughness and abrasion resistance, and can be therefore widely used for various applications. Examples of the die-cast product include body parts of automobiles or motorcycles, such as automobile brake pistons, seatbelt winder fixing parts, automobile radiator grill malls, and carburetors; industrial machine parts such as bearings and gears; VTR drum cases; keys of, for example, vending machines, lockers, and houses; precision machine parts, such as mobile phones and measuring instruments; and decoration fittings, and toys such as miniature cars.

EXAMPLES

The present invention will be described in more detail with reference to examples and comparative examples, but the scope of the present invention is not limited by the following examples.

Examples 1 to 12 and Comparative Examples 1 to 10

Zinc base alloys composed of components shown in Table 1 were produced by a melting method.

The component ratio of Comparative Example 1 corresponds to a zinc alloy, ZDC1 (JIS H 5301). The component ratio of Comparative Example 2 corresponds to a zinc alloy, ZDC2 (JIS H 5301).

Then, the obtained zinc base alloys were each die-casted with a cold-chamber type die cast machine (mold locking force: 125 ton) at a casting temperature of 500° C. to 550° C. (average: 530° C.) to obtain die-cast products.

The molds used were those having cavity sizes that can provide tensile test specimens having parallel portion of ϕ6.4 mm, gauge length of 50 mm, and length of 230 mm; specimens for measuring hardness having width of 13 mm, thickness of 7 mm, and length of 55 mm, and specimens for measuring impact energy value having width of 6.4 mm, thickness of 6.4 mm, and length of 60 mm, conforming to ASTM specifications. The molds were made of hot die steel, SKD 61.

Die-cast products were evaluated for strength properties, toughness, and abrasion resistance by the following methods. Table 2 shows the results.

1) Die-cast products having a specimen size for tensile test were measured for 0.2% proof stress, tensile strength, and breaking elongation with a precision universal testing machine (Autograph AG-50kNIS, a product of Shimadzu Co.).
2) Die-cast products having a specimen size for measuring hardness were measured for hardness with a Vickers hardness tester (VK-M, a product of Matsuzawa Co., Ltd.).
3) Die-cast products having a specimen size for measuring value of impact energy were measured for value of impact energy with a Charpy impact testing machine (MC-10, a product of Maekawa Testing Machine Mfg. Co, Ltd.).
4) Specimens for abrasion test were cut out so as to have a predetermined size from the die-cast products having a specimen size for tensile test. The specimens for abrasion test were measured for abrasion loss with a wear and abrasion testing machine (EMF-III-F, a product of Orientec Co., Ltd.). The abrasion test was conducted by pin-on-disc format under lubrication (dropping of a certain amount of lubricating oil) using die steel SKD11 as the counter material, under conditions of a sliding speed of 0.5 m/s, a sliding distance of 6,000 m, and a load of 50 kgf.

TABLE 1

| | Component (% by weight) | | | | | |
|---|---|---|---|---|---|---|
| | Al | Cu | Mg | Ca | Sr | Zn and impurities |
| Ex. 1 | 3.5 | 3.5 | 0.03 | 0.03 | — | Balance |
| Ex. 2 | 3.8 | 3.5 | 0.03 | 0.03 | — | Balance |
| Ex. 3 | 4.0 | 3.5 | 0.03 | 0.03 | — | Balance |
| Ex. 4 | 3.8 | 3.0 | 0.03 | 0.03 | — | Balance |
| Ex. 5 | 3.8 | 3.8 | 0.03 | 0.03 | — | Balance |
| Ex. 6 | 3.8 | 3.5 | 0.01 | 0.03 | — | Balance |
| Ex. 7 | 3.8 | 3.5 | 0.06 | 0.03 | — | Balance |
| Ex. 8 | 3.8 | 3.5 | 0.03 | 0.005 | — | Balance |
| Ex. 9 | 3.8 | 3.5 | 0.03 | 0.08 | — | Balance |
| Ex. 10 | 3.8 | 3.5 | 0.03 | 0.03 | 0.005 | Balance |
| Ex. 11 | 3.8 | 3.5 | 0.03 | 0.03 | 0.08 | Balance |
| Ex. 12 | 3.8 | 3.5 | 0.03 | 0.03 | 0.01 | Balance |
| Comp. Ex. 1 | 4.1 | 1.0 | 0.05 | — | — | Balance |
| Comp. Ex. 2 | 4.1 | — | 0.05 | — | — | Balance |
| Comp. Ex. 3 | 2.5 | 3.5 | 0.03 | 0.03 | — | Balance |
| Comp. Ex. 4 | 5.0 | 3.5 | 0.03 | 0.03 | — | Balance |
| Comp. Ex. 5 | 4.0 | 2.5 | 0.03 | 0.03 | — | Balance |
| Comp. Ex. 6 | 4.0 | 4.5 | 0.03 | 0.03 | — | Balance |
| Comp. Ex. 7 | 4.0 | 3.5 | — | 0.03 | — | Balance |
| Comp. Ex. 8 | 4.0 | 3.5 | 0.10 | 0.03 | — | Balance |
| Comp. Ex. 9 | 4.0 | 3.5 | 0.03 | — | — | Balance |
| Comp. Ex. 10 | 4.0 | 3.5 | 0.03 | 0.15 | — | Balance |

TABLE 2

| | Strength property | | Toughness | | Abrasion resistance | |
|---|---|---|---|---|---|---|
| | Tensile strength (MPa) | 0.2% Proof stress (MPa) | Elongation (%) | Value of impact energy (J/cm$^2$) | Hardness (Hv) | Abrasion loss (mg) |
| Ex. 1 | 360 | 257 | 1.5 | 51 | 139 | 58 |
| Ex. 2 | 369 | 271 | 0.8 | 57 | 142 | 58 |

TABLE 2-continued

| | Strength property | | Toughness | | Abrasion resistance | |
|---|---|---|---|---|---|---|
| | Tensile strength (MPa) | 0.2% Proof stress (MPa) | Elongation (%) | Value of impact energy (J/cm$^2$) | Hardness (Hv) | Abrasion loss (mg) |
| Ex. 3 | 380 | 272 | 1.1 | 59 | 142 | 57 |
| Ex. 4 | 371 | 255 | 1.2 | 51 | 140 | 50 |
| Ex. 5 | 372 | 276 | 0.9 | 52 | 141 | 57 |
| Ex. 6 | 358 | 268 | 1.0 | 63 | 141 | 59 |
| Ex. 7 | 368 | 266 | 0.9 | 63 | 143 | 56 |
| Ex. 8 | 357 | 267 | 1.0 | 80 | 140 | 53 |
| Ex. 9 | 365 | 270 | 0.9 | 55 | 142 | 58 |
| Ex. 10 | 358 | 261 | 0.9 | 65 | 143 | 44 |
| Ex. 11 | 367 | 262 | 1.0 | 62 | 147 | 55 |
| Ex. 12 | 367 | 270 | 1.1 | 63 | 147 | 48 |
| Comp. Ex. 1 | 297 | 216 | 1.1 | 96 | 128 | 75 |
| Comp. Ex. 2 | 264 | 167 | 2.3 | 86 | 105 | 78 |
| Comp. Ex. 3 | 317 | 232 | 0.8 | 52 | 133 | 98 |
| Comp. Ex. 4 | 394 | 285 | 0.5 | 43 | 149 | 62 |
| Comp. Ex. 5 | 347 | 250 | 0.9 | 63 | 134 | 84 |
| Comp. Ex. 6 | 379 | 273 | 0.7 | 35 | 143 | 51 |
| Comp. Ex. 7 | 326 | 219 | 2.1 | 50 | 119 | 96 |
| Comp. Ex. 8 | 365 | 276 | 0.5 | 22 | 148 | 61 |
| Comp. Ex. 9 | 343 | 252 | 1.1 | 96 | 138 | 80 |
| Comp. Ex. 10 | 371 | 278 | 0.6 | 42 | 150 | 79 |

As shown in Table 2, the zinc base alloys of Examples 1 to 12 according to the present invention had high strength and were excellent in toughness and abrasion resistance.

On the other hand, the zinc base alloys of Comparative Examples 1, 2, 3, 5, 7 and 9 were inferior in strength properties and abrasion resistance, while being excellent in toughness.

The zinc base alloys of Comparative Examples 4, 6, 8 and 10 were insufficient in toughness, while being excellent in strength properties and abrasion resistance.

The invention claimed is:

1. A zinc alloy consisting of 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, and balance of Zn and inevitable impurities.

2. The zinc alloy according to claim 1, in which the Al content is 3.5% by weight or more and 4.0% by weight or less, the Cu content is 3.0% by weight or more and 3.8% by weight or less, the Mg content is 0.02% by weight or more and 0.06% by weight or less, and the Ca content is 0.005% by weight or more and 0.06% by weight or less.

3. The zinc alloy according to claim 1, in which the alloy has an α-phase and a β-phase, Al is solid-dissolved in the α-phase, and Cu is solid-dissolved in the α-phase and the β-phase.

4. The zinc alloy according to claim 1, in which the alloy contains a Zn—Cu—Ca intermetallic compound.

5. A die-casting product composed of the zinc alloy according to claim 1.

6. A zinc alloy consisting of 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, 0.005% by weight or more and 0.1% by weight or less of Sr, and balance of Zn and inevitable impurities.

7. The zinc alloy according to claim 6, in which the Al content is 3.5% by weight or more and 4.0% by weight or less, the Cu content is 3.0% by weight or more and 3.8% by weight or less, the Mg content is 0.02% by weight or more and 0.06% by weight or less, the Ca content is 0.005% by weight or more and 0.06% by weight or less, and the Sr content is 0.005% by weight or more and 0.06% by weight or less.

8. The zinc alloy according to claim 6, in which the alloy has an α-phase and a β-phase, Al is solid-dissolved in the α-phase, and Cu is solid-dissolved in the α-phase and the β-phase.

9. The zinc alloy according to claim 6, in which the alloy contains a Zn—Cu—Ca intermetallic compound.

10. A die-casting product composed of the zinc alloy according to claim 6.

11. A zinc alloy consisting of 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, and balance of Zn.

12. The zinc alloy according to claim 11, in which the Al content is 3.5% by weight or more and 4.0% by weight or less, the Cu content is 3.0% by weight or more and 3.8% by weight or less, the Mg content is 0.02% by weight or more and 0.06% by weight or less, and the Ca content is 0.005% by weight or more and 0.06% by weight or less.

13. The zinc alloy according to claim 11, in which the alloy has an α-phase and a β-phase, Al is solid-dissolved in the α-phase, and Cu is solid-dissolved in the α-phase and the β-phase.

14. The zinc alloy according to claim 11, in which the alloy contains a Zn—Cu—Ca intermetallic compound.

15. A die-casting product composed of the zinc alloy according to claim 11.

16. A zinc alloy consisting of 3.5% by weight or more and 4.5% by weight or less of Al, 3.0% by weight or more and 4.0% by weight or less of Cu, 0.01% by weight or more and 0.08% by weight or less of Mg, 0.005% by weight or more and 0.1% by weight or less of Ca, 0.005% by weight or more and 0.1% by weight or less of Sr, and balance of Zn.

17. The zinc alloy according to claim 16, in which the Al content is 3.5% by weight or more and 4.0% by weight or less, the Cu content is 3.0% by weight or more and 3.8% by weight or less, the Mg content is 0.02% by weight or more and 0.06% by weight or less, the Ca content is 0.005% by weight or more and 0.06% by weight or less, and the Sr content is 0.005% by weight or more and 0.06% by weight or less.

18. The zinc alloy according to claim 16, in which the alloy has an α-phase and a β-phase, Al is solid-dissolved in the α-phase, and Cu is solid-dissolved in the α-phase and the β-phase.

19. The zinc alloy according to claim 16, in which the alloy contains a Zn—Cu—Ca intermetallic compound.

20. A die-casting product composed of the zinc alloy according to claim 16.

* * * * *